US010315887B2

(12) United States Patent
Kilpeläinen

(10) Patent No.: US 10,315,887 B2
(45) Date of Patent: Jun. 11, 2019

(54) ARRANGEMENT AND METHOD FOR ALIGNING GUIDE RAILS IN AN ELEVATOR SHAFT

(71) Applicant: KONE Corporation, Helsinki (FI)

(72) Inventor: Pekka Kilpeläinen, Oulu (FI)

(73) Assignee: KONE CORPORATION, Helsinki (FI)

( * ) Notice: Subject to any disclaimer, the term of this patent is extended or adjusted under 35 U.S.C. 154(b) by 506 days.

(21) Appl. No.: 15/090,021

(22) Filed: Apr. 4, 2016

(65) Prior Publication Data

US 2016/0311658 A1 Oct. 27, 2016

(30) Foreign Application Priority Data

Apr. 23, 2015 (EP) ..... 15164765

(51) Int. Cl.
*B66B 7/02* (2006.01)
*B66B 19/00* (2006.01)

(52) U.S. Cl.
CPC ..... *B66B 19/002* (2013.01); *B66B 7/023* (2013.01)

(58) Field of Classification Search
CPC ..... B66B 19/002; B66B 7/023; B66B 7/02
See application file for complete search history.

(56) References Cited

U.S. PATENT DOCUMENTS 8,256,582 B2 * 9/2012 Qiu ..... B66B 19/00 187/391
2012/0291395 A1 * 11/2012 Plathin ..... B66B 19/00 52/741.1
2014/0138189 A1 * 5/2014 van der Meijden ..... B66B 7/02 187/406
2015/0217972 A1 * 8/2015 Hawkins ..... G01C 15/10 187/391
2016/0068369 A1 * 3/2016 Valkama ..... B66B 5/0087 33/645

FOREIGN PATENT DOCUMENTS

CN 1587905 A 3/2005
JP 9-221288 A 8/1997
WO WO-9323323 A1 * 11/1993 ..... B66B 7/02
WO WO 2007/135228 A1 11/2007
WO WO 2014/053184 A1 4/2014

OTHER PUBLICATIONS

English Machine Translation of JPH 09-221288.*

* cited by examiner

*Primary Examiner* — Diem M Tran
(74) *Attorney, Agent, or Firm* — Birch, Stewart, Kolasch & Birch, LLP

(57) ABSTRACT

An arrangement for aligning guide rails includes an installation platform arranged to be movable in the first direction upwards and downwards in an elevator shaft, said installation platform being provided with an apparatus for aligning guide rails. At least two laser transmitters are arranged at predetermined positions in the shaft below the installation platform, each of said at least two laser transmitters transmitting an upwards directed laser beam that forms a plumb line in the elevator shaft. At least two first position sensitive detectors are attached to the installation platform and/or to the apparatus for aligning guide rails and/or to the guide rails, each of said at least two first position sensitive detectors receiving a respective laser beam, whereby the position of the guide rails in relation to the shaft can be determined indirectly or directly.

19 Claims, 11 Drawing Sheets

ARRANGEMENT AND METHOD FOR ALIGNING GUIDE RAILS IN AN ELEVATOR SHAFT

FIELD OF THE INVENTION

The invention relates to an arrangement and a method for aligning guide rails in an elevator shaft.

BACKGROUND ART

An elevator comprises an elevator car, lifting machinery, ropes, and a counterweight. The elevator car is supported on a transport frame being formed by a sling or a car frame. The sling surrounds the elevator car. The lifting machinery moves the car upwards and downwards in a vertically extending elevator shaft. The sling and thereby also the elevator car are carried by the ropes, which connect the elevator car to the counterweight. The sling is further supported with gliding means at guide rails extending in the vertical direction in the elevator shaft. The gliding means can comprise rolls rolling on the guide rails or gliding shoes gliding on the guide rails when the elevator car is mowing upwards and downwards in the elevator shaft. The guide rails are supported with fastening means on the side wall structures of the elevator shaft. The gliding means engaging with the guide rails keep the elevator car in position in the horizontal plane when the elevator car moves upwards and downwards in the elevator shaft. The counterweight is supported in a corresponding way on guide rails supported with fastening means on the wall structure of the elevator shaft. The elevator car transports people and/or goods between the landings in the building. The elevator shaft can be formed so that one or several of the side walls are formed of solid walls and/or so that one or several of the side walls are formed of an open steel structure.

The guide rails are formed of guide rail elements of a certain length. The guide rail elements are connected in the installation phase end-on-end one after the other in the elevator shaft. The guide rails are attached to the walls of the elevator shaft with fastening means at fastening points along the height of the guide rails.

WO publication 2007/135228 discloses a method for installing the guide rails of an elevator. In the first phase a first pair of opposite car guide rail elements is installed starting from the bottom of the shaft. In the second phase a second pair of opposite car guide rails is installed end-on-end with the first pair of opposite car guide rails. The process is continued until all the pairs of opposite car guide rails have been installed. The counterweight guide rails are installed in a corresponding manner. A laser transmitter is used in connection with each guide rail to align the guide rail in the vertical direction. A self-directional laser could be used, which automatically directs the laser beam vertically upwards. The laser transmitters are first positioned at the bottom of the shaft when the lowermost section of guide rails is installed. An alignment appliance provided with an alignment element is supported on each guide rail at each position where the alignment of the guide rail is to be done. The laser beam hits the alignment element, whereby the guide rail can be aligned so that the hitting point of the laser beam is in the middle of the alignment element. The laser transmitters are moved stepwise upwards for alignment of the next section of guide rails.

WO publication 2014/053184 discloses a guide rail straightness measuring system for elevator installations. The measuring system comprises at least one plumb line mounted vertically in the elevator shaft adjacent to the guide rail and at least one sensor arrangement to be mounted on a carrier to travel vertically along the guide rail. The sensor arrangement comprises a frame, at least one guide shoe connected to the frame for sliding or rolling along the guide surface of the guide rail, a bias means for placing and biasing the frame against the guide surface, and at least one sensor means for sensing the position of the plumb line with respect to the frame.

BRIEF DESCRIPTION OF THE INVENTION

An object of the present invention is to present a novel arrangement and method for aligning guide rails in an elevator shaft.

The arrangement for aligning guide rails in an elevator shaft is defined in claim 1.

The elevator shaft has a bottom, a top, side walls, a first direction coinciding with a vertical direction in the elevator shaft, a second direction extending between car guide rails on opposite side walls in the elevator shaft and a third direction extending between a back wall and a front wall in the elevator shaft.

The arrangement is characterised in that:

an installation platform is arranged to be movable in the first direction upwards and downwards in the elevator shaft, said installation platform being provided with an apparatus for aligning guide rails, at least two laser transmitters are arranged at predetermined positions in the shaft below the installation platform, each of said at least two laser transmitters transmitting an upwards directed laser beam that forms a plumb line in the elevator shaft, at least two first position sensitive detectors are attached to the installation platform and/or to the apparatus for aligning guide rails and/or to the guide rails, each of said at least two first position sensitive detectors receiving a respective laser beam, whereby the position of the guide rails in relation to the shaft can be determined indirectly or directly.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
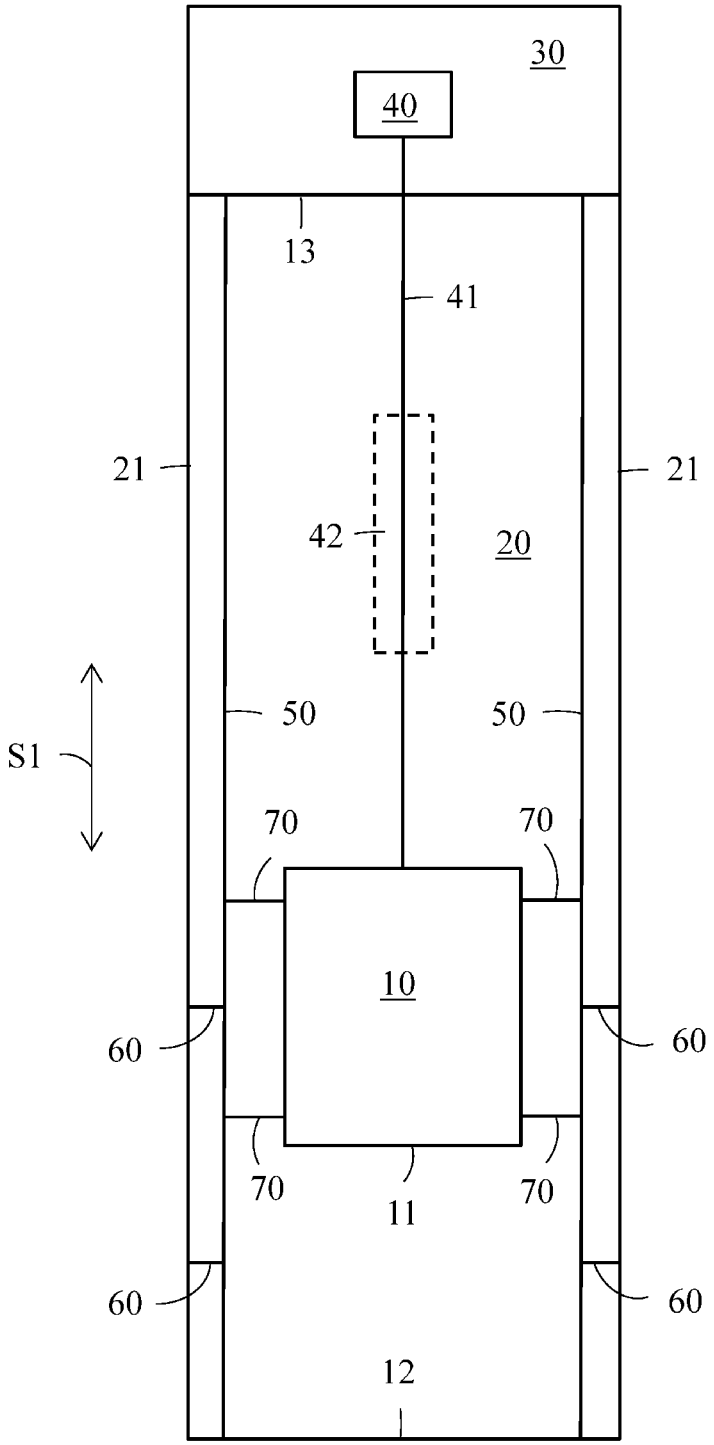
FIG. 1 shows a vertical cross section of an elevator.
Figure 2:
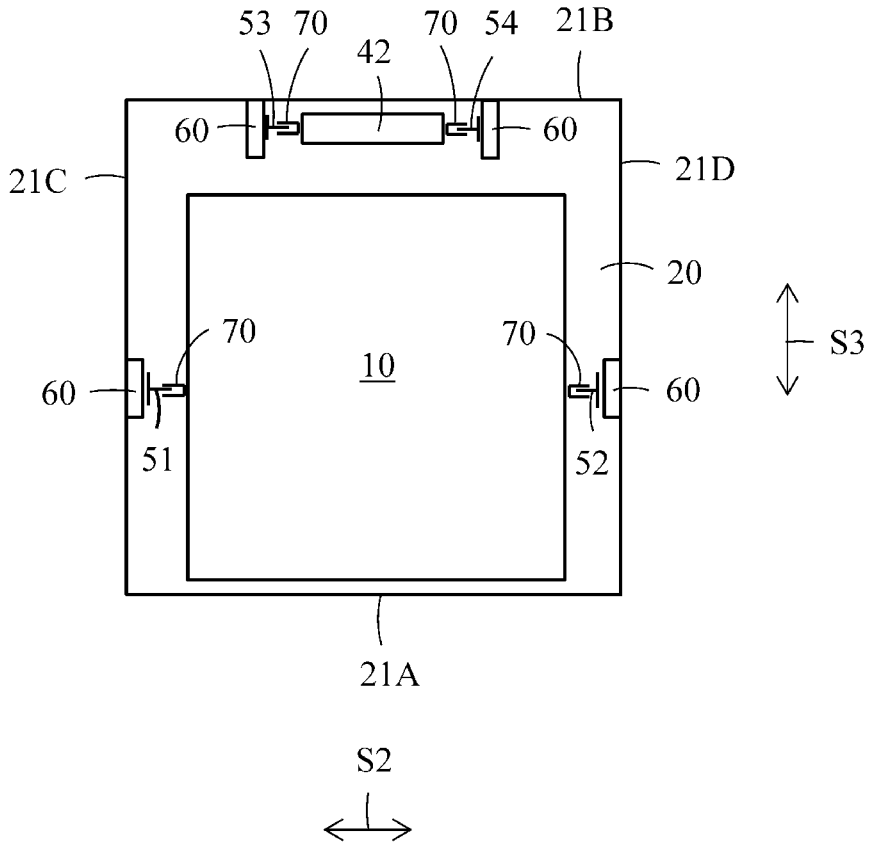
FIG. 2 shows a horizontal cross section of the elevator.

FIG. 1 shows a vertical cross section and FIG. 2 shows a horizontal cross section of an elevator.

The elevator comprises a car 10, an elevator shaft 20, a machine room 30, lifting machinery 40, ropes 41, and a counter weight 42. The car 10 may be supported on a transport frame 11 or a sling surrounding the car 10. The lifting machinery 40 moves the car 10 in a first direction S1 upwards and downwards in a vertically extending elevator shaft 20. The sling 11 and thereby also the elevator car 10 are carried by the ropes 41, which connect the elevator car 10 to the counter weight 42. The sling 11 and thereby also the elevator car 10 is further supported with gliding means 70 at guide rails 50 extending in the vertical direction in the elevator shaft 20. The elevator shaft 20 has a bottom 12, a top 13, a front wall 21A, a back wall 21B, a first side wall 21C and a second opposite side wall 21D. There are two car guide rails 51, 52 positioned on opposite side walls 21C, 21D of the elevator shaft 20. The gliding means 70 can comprise rolls rolling on the guide rails 50 or gliding shoes gliding on the guide rails 50 when the elevator car 10 is mowing upwards and downwards in the elevator shaft 20. There are further two counter weight guide rails 53, 54 positioned at the back wall 21B of the elevator shaft 20. The counter weight 42 is supported with corresponding gliding means 70 on the counter weight guide rails 53, 54. The landing doors (not shown in the figure) are positioned in connection with the front wall 21A of the elevator shaft 20.

Each car guide rail 51, 52 is fastened with fastening means 60 at the respective side wall 21C, 21D of the elevator shaft 20 along the height of the car guide rail 51, 52. Each counter weight guide rail 53, 54 is fastened with corresponding fastening means 60 at the back wall 21B of the elevator shaft 20 along the height of the counter weight guide rail 53, 54. The figure shows only two fastening means 60, but there are several fastening means 60 along the height of each guide rail 50. The cross section of the guide rails 50 can have the form of a letter T. The vertical branch of the guide rail element 50 forms three gliding surfaces for the gliding means 70 comprising rolls or gliding shoes. There are thus two opposite side gliding surfaces and one front gliding surface in the guide rail 50. The cross-section of the gliding means 70 can have the form of a letter U so that the inner surface of the gliding means 70 sets against the three gliding surfaces of the guide rail 50. The gliding means 70 are attached to the sling 11 and/or to the counter weight 42.

The gliding means 70 engage with the guide rails 50 and keep the elevator car 10 and/or the counter weight 42 in position in the horizontal plane when the elevator car 10 and/or the counter weight 42 moves upwards and downwards in the first direction S1 in the elevator shaft 20. The elevator car 10 transports people and/or goods between the landings in the building. The elevator shaft 20 can be formed so that all side walls 21, 21A, 21B, 21C, 21D are formed of solid walls or so that one or several of the side walls 21, 21A, 21B, 21C, 21D are formed of an open steel structure.

The guide rails 50 extend vertically along the height of the elevator shaft 20. The guide rails 50 are thus formed of guide rail elements of a certain length e.g. 5 m. The guide rail elements 50 are installed end-on-end one after the other.

FIG. 1 shows a first direction S1, which is a vertical direction in the elevator shaft 20. FIG. 2 shows a second direction S2, which is the direction between the first side wall 21C and the second side wall 21D in the elevator shaft 20 i.e. the direction between the guide rails (DBG). FIG. 2 shows further a third direction S3, which is the direction between the back wall 21B and the front wall 21A in the elevator shaft 20 i.e. the back to front direction (BTF). The second direction S2 is perpendicular to the third direction S3. The second direction S2 and the third direction S3 form a coordinate system in a horizontal plane in the elevator shaft 20.

Figure 3:
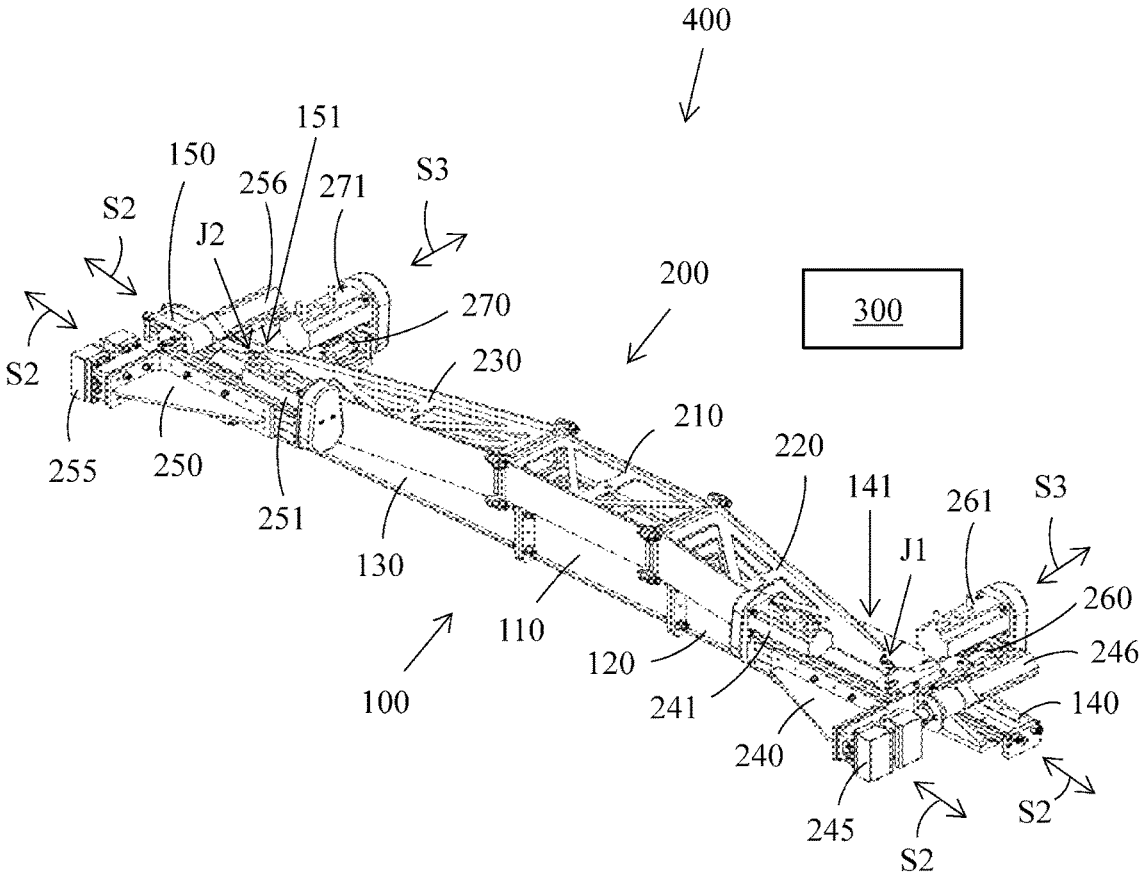
FIG. 3 shows an axonometric view of an apparatus for aligning guide rails in an elevator shaft.

FIG. 3 shows an axonometric view of an apparatus for aligning guide rails in an elevator shaft. The apparatus 400 for aligning guide rails 50 comprises a positioning unit 100 and an alignment unit 200.

The positioning unit 100 comprises a longitudinal support structure with a middle portion 110 and two opposite end portions 120, 130. The two opposite end portions 120, 130 are mirror images of each other. There could be several middle portions 110 of different lengths in order to adjust the length of the positioning unit 100 to different elevator shafts 20. The positioning unit 100 comprises further first attachment means 140, 150 at both ends of the positioning unit 100. The first attachment means 140, 150 are movable in the second direction S2 i.e. the direction between the guide rails (DBG). The positioning unit 100 extends across the elevator shaft 20 in the second direction S2. The first attachment means 140, 150 are used to lock the positioning unit 100 between the wall structures 21 and/or dividing beams and/or brackets 60 in the elevator shaft 20. An actuator 141, 151 (position shown only schematically in the figure) e.g. a linear motor in connection with each of the first attachment means 140, 150 can be used to move each of the first attachment means 140, 150 individually in the second direction S2.

The alignment unit 200 comprises a longitudinal support structure with a middle portion 210 and two opposite end portions 220, 230. The two opposite end portions 220, 230 are mirror images of each other. There could be several middle portions 210 of different lengths in order to adjust the length of the alignment unit 200 to different elevator shafts 20. The alignment unit comprises further second attachment means 240, 250 at both ends of the alignment unit 200. The second attachment means 240, 250 are movable in the second direction S2. An actuator 241, 251 e.g. a linear motor can be used to move each of the second attachment means 240, 250 individually in the second direction S2. Each of the second attachment means 240, 250 comprises further gripping means in the form of jaws 245, 255 positioned at the end of the second attachment means 240, 250. The jaws 245, 255 are movable in the third direction S3 perpendicular to the second direction S2. The jaws 245, 255 will thus grip on the opposite side surfaces of the guide rails 50. An actuator 246, 256 e.g. a linear motor can be used to move each of the jaws 245, 255 individually in the third direction S3. The alignment unit 200 is attached to the positioning unit 100 at each end of the positioning unit 100 with support parts 260, 270. The support parts 260, 270 are movable in the third direction S3 in relation to the positioning unit 100. The alignment unit 200 is attached with articulated joints J1, J2 to the support parts 260, 270. An actuator 261, 271 e.g. a linear motor can be used to move each of the support parts 260, 270 individually in the third direction S3. The articulated joints J1, J2 make it possible to adjust the alignment unit 200 so that it is non-parallel to the positioning unit 100.

The two second attachment means 240, 250 are moved with the actuators 241, 251 only in the second direction S2. It would, however, be possible to add a further actuator to one of the second attachment means 240, 250 in order to be able to turn said second attachment means 240, 250 in the horizontal plane around an articulated joint. It seems that such a possibility is not needed, but such a possibility could be added to the apparatus 500 if needed.

The apparatus 400 can be operated by a mechanic or automatically by means of a control unit 300. The control unit 300 can be attached to the apparatus 400 or it can be a separate entity that is connectable with a cable to the apparatus 400. There can naturally also be a wireless communication between the control unit 300 and the apparatus 400. The control unit 300 is used to control all the actuators 141, 142 moving the first attachment means 140, 150, the actuators 241, 242 moving the second attachment means 240, 250, the actuators 246, 256 moving the gripping means 245, 255 and the actuators 261, 271 moving the support parts 260, 270.

Figure 4:
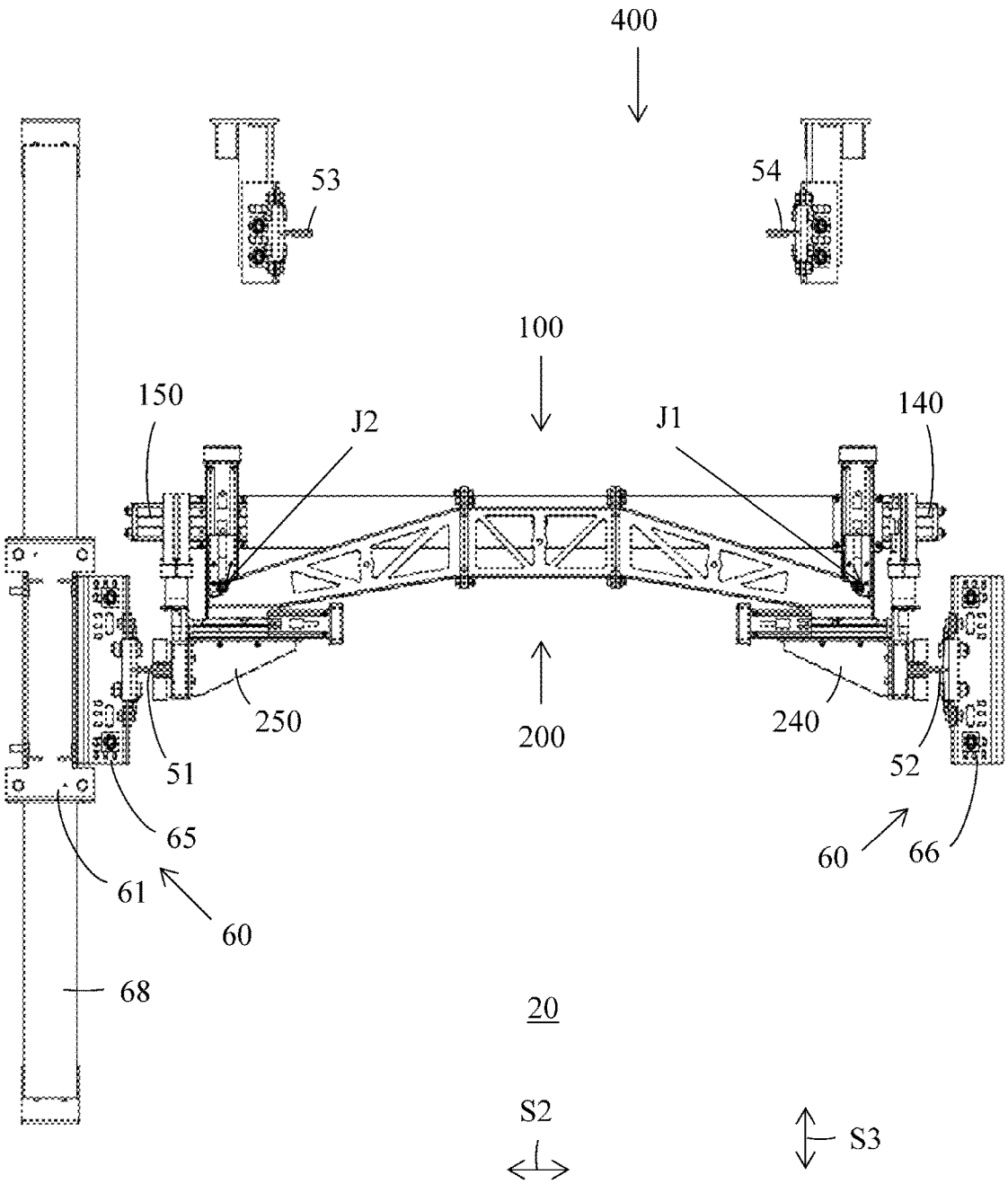
FIG. 4 shows a first phase of the operation of the apparatus of FIG. 3.

FIG. 4 shows a first phase of the operation of the apparatus of FIG. 3. The guide rails 51, 52 are attached to brackets 65, 66 and the brackets 65, 66 can be attached directly to the side wall 21C of the shaft 20 or through a support bar 68 extending between the back wall 21B and the front wall 21A of the shaft 20. The bracket 65 is attached to a bar bracket 61 and the bar bracket 61 is attached to the support bar 68. The apparatus 400 can be supported on an installation platform and lifted with the installation platform to a height location of the first fastening means 60 during the alignment of the guide rails 50. A mechanic may be travelling on the installation platform. The apparatus 400 may be operated by a mechanic or automatically be means of the control unit 300 so that the alignment unit 200 is controlled to attach with the jaws 245, 255 at the ends of the second attachment means 240, 250 to the two opposite guide rails 51, 52. The second attachment means 240, 250 are movable in the second direction S2 and the jaws 245, 255 are movable in the third direction S3 so that they can grip on the opposite vertical side surfaces of the guide rails 51, 52. The bolts of the fastening means 60 are then opened at both sides of the shaft 20 so that the guide rails 51, 52 can be moved. The guide rails 51, 52 on opposite sides of the shaft 20 are then adjusted relative to each other with the alignment unit 200. The frame of the alignment unit 200 is stiff so that the two opposite guide rails 51, 52 will be positioned with the apexes facing towards each other when the gripping means 245, 255 grips the guide rails 50. There is thus no twist between the opposite guide rails 50 after this. The distance between the two opposite guide rails 50 in the direction (DBG) is also adjusted with the alignment unit 200. The position of each of the second attachment means 240, 250 in the second direction S2 determines said distance.

There is a plumb line formed in the vicinity of each guide rail 51, 52 (not shown in the figure). The distance in the DBG and the BTF direction from the guide rails 51, 52 to the respective plumb line that is in the vicinity of said guide rail 51, 52 is then determined. The needed control values (DBG, BTF and twist) for the apparatus 400 are then calculated. The control values are then transformed into incremental steps, which are fed as control signals to the control units of the linear motors in the apparatus 400. The DBG can also be measured based on the motor torque, which indicates when the second attachment means 240, 250 have reached their end position and are positioned against the guide rails 50. The position of the linear motors can then be read from the display of the control unit 300. The apparatus 400 can thus calculate the DBG based on the distance of the guide rails 51, 52 to the plumb lines and based on the position of each of the second attachment means 240, 250 in the second direction S2.

Figure 5:
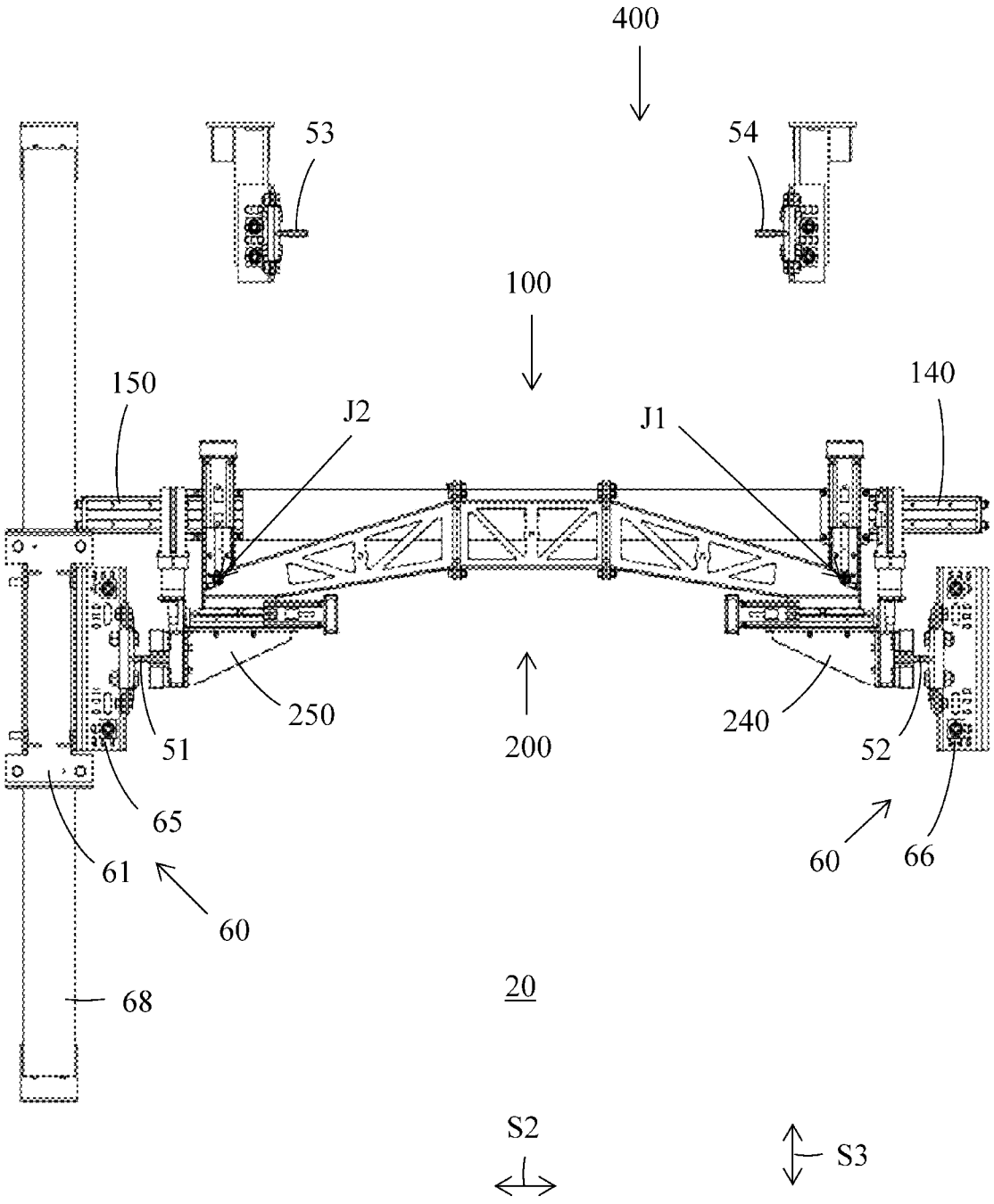
FIG. 5 shows a second phase of the operation of the apparatus of FIG. 3.

FIG. 5 shows a second phase of the operation of the apparatus of FIG. 3. The positioning unit 100 of the apparatus 400 is locked to the wall constructions 21 or other support structures in the elevator shaft 20 with the first attachment means 140, 150. The alignment unit 200 of the apparatus 400 is in a floating mode in relation to the positioning unit 100 when the positioning unit 100 is locked to the wall construction 21 of the elevator shaft 20. The guide rails 51, 52 can now be adjusted with the alignment unit 200 and the positioning unit 100 in relation to the shaft 20. The bolts of the fastening means 60 are then tightened. The apparatus 400 can now be transported to the next location of the fastening means 60 where the first phase and the second phase of the operation of the apparatus 400 is repeated.

Figure 6:
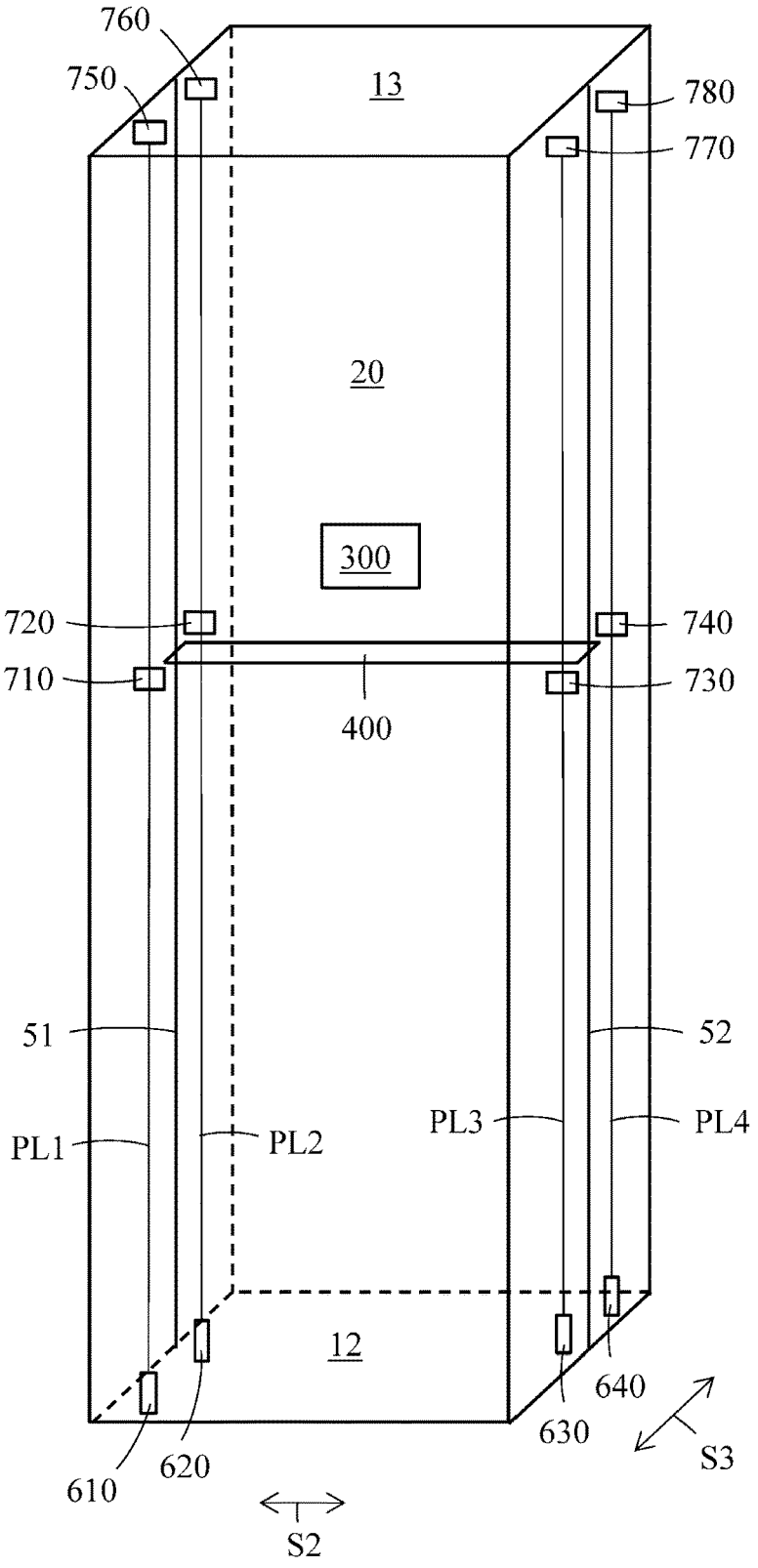
FIG. 6 shows an axonometric view of an elevator shaft showing the principle of the invention.

FIG. 6 shows an axonometric view of an elevator shaft showing the principle of the invention. The figure shows the apparatus 400 for aligning the guide rails. The apparatus 400 for aligning the guide rails is mounted on an installation platform 500 (shown in FIGS. 8-13) being arranged to be movable in the first direction S1 upwards and downwards in the elevator shaft 20.

There are four laser transmitters 610, 620, 630, 640 arranged at predetermined positions on the bottom 12 of the elevator shaft 20. Two of the laser transmitters 610, 620 are arranged in the vicinity of the first car guide rail 51 at each side of the first car guide rail 51 and two of the laser transmitters 630, 640 are arranged in the vicinity of the second car guide rail 52 at each side of the second guide rail 52. The position of each laser transmitter 610, 620, 630, 640 in the second direction S2 and in the third direction S3 within the elevator shaft 20 is thus known. Each laser transmitter 610, 620, 630, 640 produces a laser beam PL1, PL2, PL3, PL4 which is directed vertically upwards in the elevator shaft 20 and forms a plumb line in the elevator shaft 20. The four laser transmitters 610, 620, 630, 640 are positioned on the bottom 12 of the shaft 20, but they can naturally be raised to a higher position in the shaft 20 during the installation if needed. This might be needed in a very high shaft 20 if the laser beam PL1, PL2, PL3, PL4 would not reach through the whole height of the shaft 20. The installation could then be done stepwise one section of guide rails 50 at a time. The laser transmitters 610, 620, 630, 640 could be raised after the previous section of guide rails have been installed and aligned.

There are further four first position sensitive detectors (PSD) 710, 720, 730, 740 arranged in connection with the apparatus 400 for aligning the guide rails. Each of the first PSD:s 710, 720, 730, 740 is arranged so that it receives a respective laser beam PL1, PL2, PL3, PL4. The PSD measures the point where the laser beam PL1, PL2, PL3, PL4 hits the position sensitive area of the respective PSD. The output signal of each PSD is transferred to a control unit 300 associated with the apparatus 400 for aligning guide rails. The position of the apparatus 400 for aligning guide rails in relation to the laser beams PL1, PL2, PL3, PL4 forming the plumb lines in the shaft 20 can thus be determined in the second direction S2 and in the third direction S3 based on the measurements of the PSD:s 710, 720, 730, 740.

The figure shows further four optional second position sensitive detectors 750, 760, 770, 780 positioned at the top 13 of the elevator shaft 20. These second PSD:s 750, 760, 770, 780 can be used as reference sensors in order to be able to detect bending of a high rise building. The first position sensitive detectors 710, 720, 730, 740 are in this case transparent sensors with an integrated beam splitter, which means that they let the laser beam PL1, PL2, PL3, PL4 go through so that also the second PSD:s 750, 760, 770, 780 can detect the laser beam PL1, PL2, PL3, PL4. The second PSD:s 750, 760, 770, 780 are arranged on the top 13 of the elevator shaft so that each vertically directed laser beam PL1, PL2, PL3, PL4 hits the middle point of a respective second PSD 750, 760, 770, 780 in a situation where the building is straight i.e. there is no wind acting on the building. The laser transmitters 610, 620, 630, 640 can be provided with an automatic directing functionality, which can be achieved e.g. with servo motors. The orientation of the laser beams PL1, PL2, PL3, PL4 can thus be maintained with the servo motors so that they always point to the middle point of the second PSDs 750, 760, 770, 780. The four optional second position sensitive detectors 750, 760, 770, 780 are positioned at the top 13 of the shaft 20, but they can naturally be lowered to a lower position in the shaft 20 during the installation if needed. This might be needed in a very high shaft 20 if the laser beams PL1, PL2, PL3, PL4 would not reach through the whole height of the shaft 20. The installation could then be done stepwise one section of guide rails 50 at a time. The second position sensitive detectors 750, 760, 770, 780 could first be positioned in a first position between the installation platform 500 and the top 13 of the shaft 20. The second position sensitive detectors 750, 760, 770, 780 could then be raised in synchronism with the raising of the laser transmitters 610, 620, 630, 640.

Figure 7:
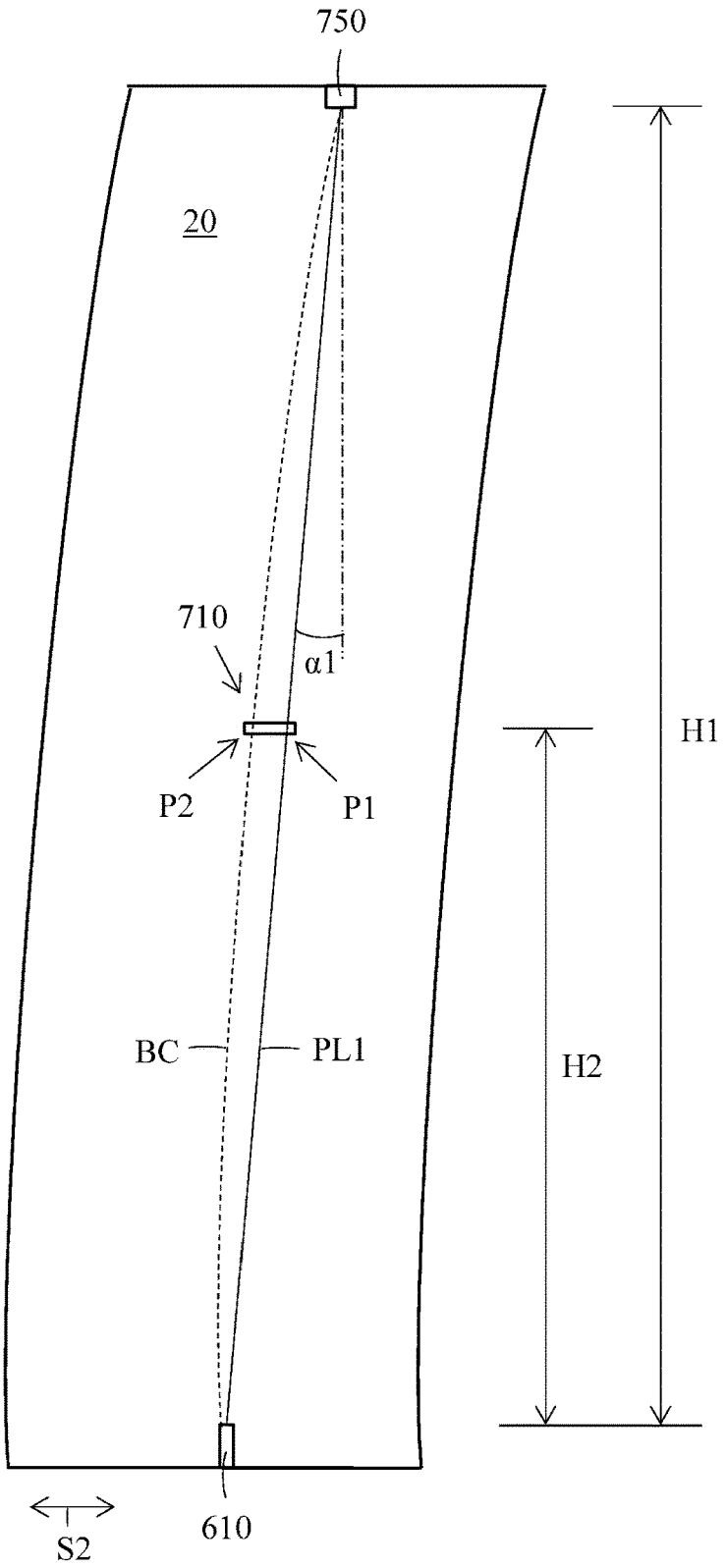
FIG. 7 shows a vertical cross section of a curved elevator shaft showing the principle of the invention in such a case.

FIG. 7 shows a vertical cross section of a curved elevator shaft showing the principle of the invention in such a case. The bending of the elevator shaft 20 is greatly exaggerated in the figure in order to clarify the situation. The figure shows only one laser transmitter 610, one first position sensitive detector 710 and one second position sensitive detector 750. The laser beam PL1 produced by the laser transmitter 610 forms a first angle $\alpha 1$ with the vertical direction as said laser beam PL1 is automatically directed to the centre of second position sensitive detector 750. The second position sensitive detector 750 is thus not positioned on the vertical line extending upwards from the laser transmitter 610 due to the bending of the elevator shaft 20. The laser beam PL1 produced by the laser transmitter 610 hits the first PSD 710 at a first point P1. The magnitude and the direction in the second direction S2 and the third direction S3 of the first angle $\alpha 1$ of the laser beam PL1 in relation to the vertical direction is known. The vertical height H1 distance between the laser transmitter 610 and the second PSD 750 is also known. The vertical height position H2 of the first PSD 710 is also known. This information makes it possible to take into consideration the bending of the building. A predetermined bending curve BC can be fitted between the laser transmitter 610 and the second PSD 750 so that the bending of the curve follows the bending of the elevator shaft 20. The bending curve BC hits the first PSD 710 at a second point P2. The second point P2 is thus the corrected hitting point of the laser beam PL1 taking into account the bending of the elevator shaft 20. This correction can be done for all laser beams.

Figure 8:
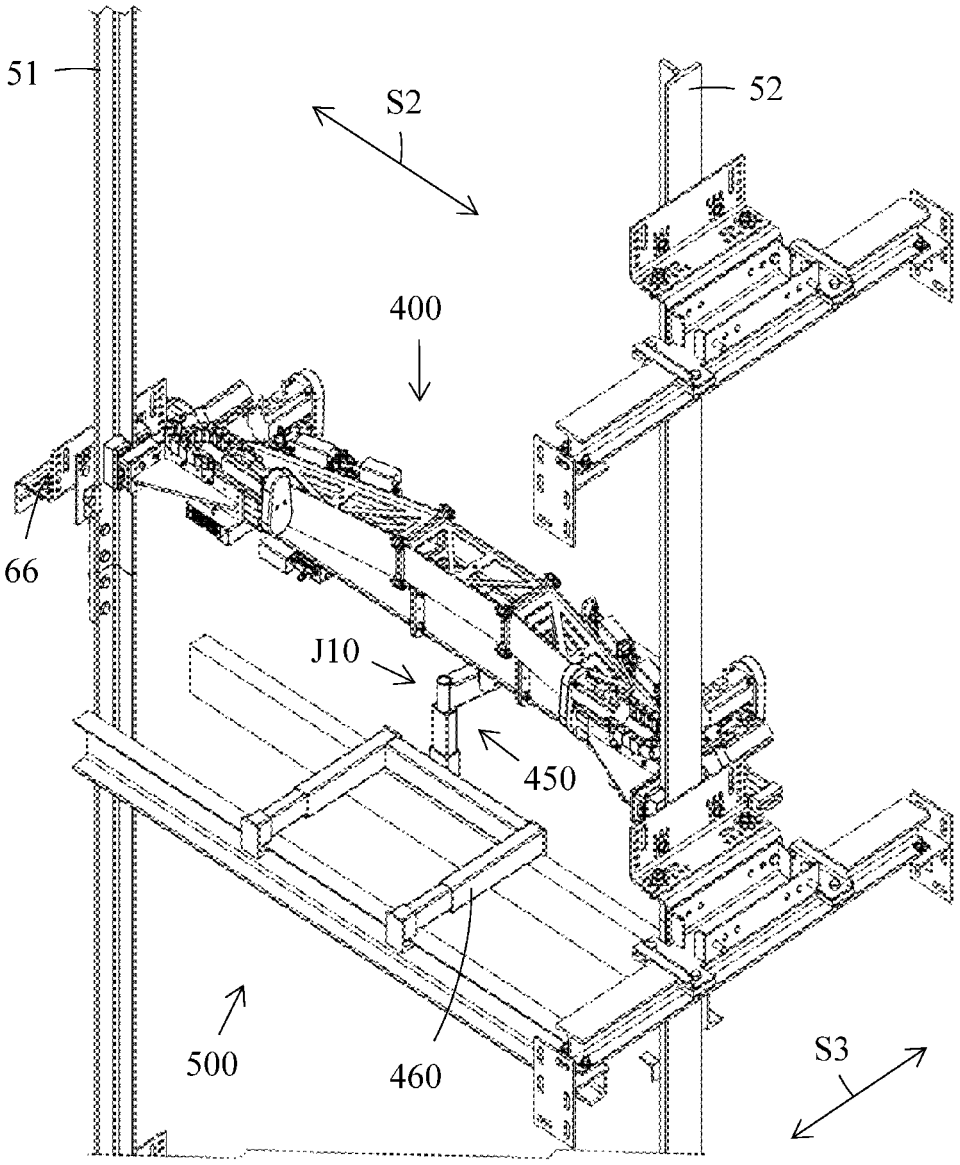
FIG. 8 shows an axonometric view of the alignment of guide rails in an elevator shaft.

FIG. 8 shows an axonometric view of the alignment of guide rails in an elevator shaft. The figure shows the car guide rails 51, 52, the installation platform 500 and the apparatus 400 for aligning the guide rails 51, 52. The apparatus 400 for aligning the guide rails 51, 52 is attached with a support arm 450 to a support frame 460 and the support frame 460 is attached to the installation platform 500. The apparatus 400 for aligning the guide rails 51, 52 has to be movable in the second direction S2 and in the third direction S3 in relation to the installation platform 500. This can be achieved with one or several joints J10 in the support arm 450. The support frame 460 can also be arranged to be movable in the second direction S2 and in the third direction S3.

Figure 9:
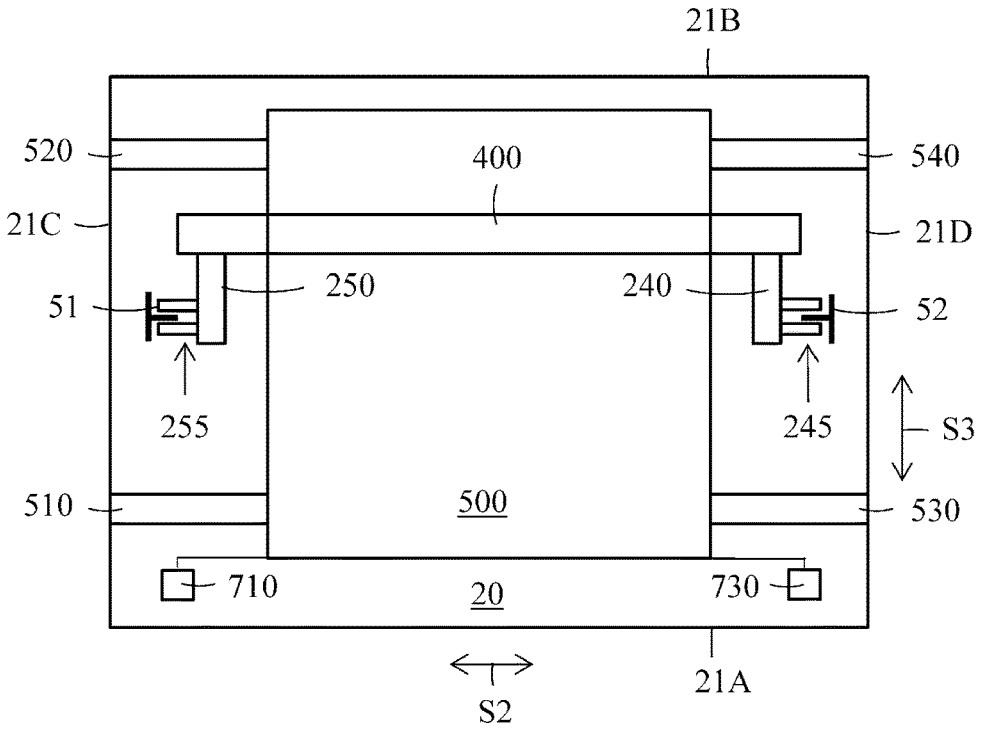
FIG. 9 shows a horizontal cross section of the elevator shaft showing a first embodiment of the invention.

FIG. 9 shows a horizontal cross section of the elevator shaft showing a first embodiment of the invention. The figure shows the installation platform 500, the apparatus 400 for aligning guide rails and two first position sensitive detectors 710, 720 supported on the installation platform 500. The installation platform 500 comprises support arms 510, 520, 530, 540 arranged on opposite sides of the installation platform 500 and being movable in a second direction S2 for supporting the installation platform 500 on the opposite side walls 21C, 21D of the shaft 20. The gripping means 245, 255 of the second attachment means 240, 250 can grip the opposite guide surfaces of the car guide rails 51, 52. The car guide rails 51, 52 can thus be aligned with the apparatus 400 for alignment of guide rails as described earlier in connection with FIGS. 3-5. The installation platform 500 is locked in place with the support arms 510, 520, 530, 540. The position of the installation platform 500 in relation to the shaft 20 is determined with the position sensitive detectors 710, 730 once the installation platform 500 is locked in the shaft 20. When the coordinates of the stationary installation platform 500 are determined, then it is possible to determine the coordinates of the apparatus 400 in relation to the installation platform 50 continuously during the alignment procedure. The apparatus 400 is attached to the installation platform 500, whereby the position of the apparatus 400 can be determined indirectly based on the position of them installation platform 500. The position of the guide rails 51, 52 can be determined indirectly based on the position of the apparatus 400. This arrangement could be used e.g. in a case where the visibility to the apparatus 400 is restricted so that the first position sensitive detectors 710, 730 cannot be attached to the apparatus 400.

Figure 10:
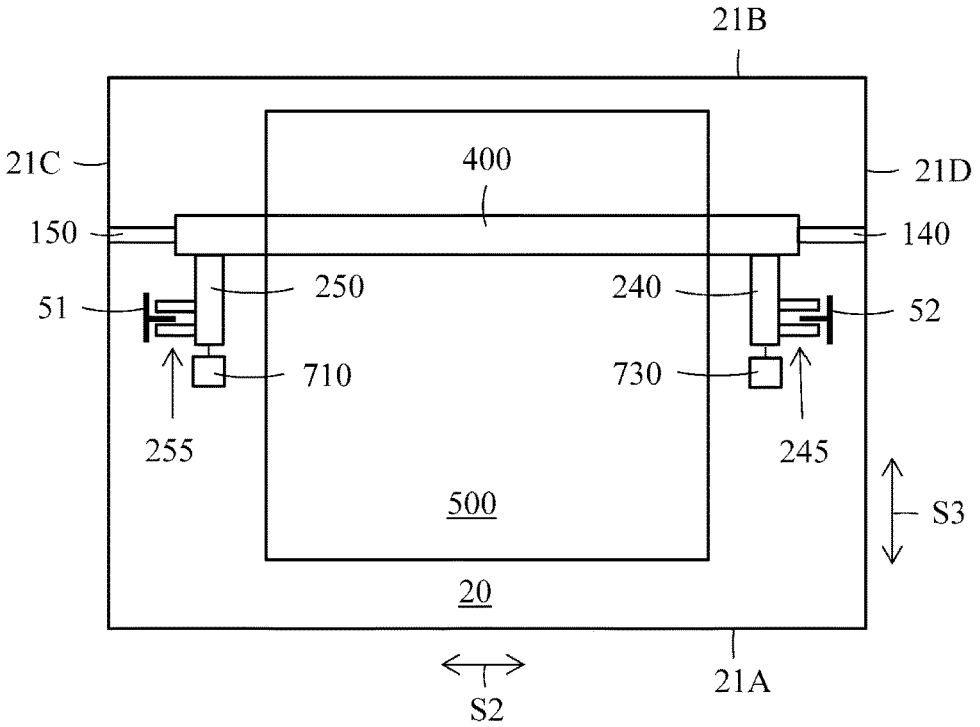
FIG. 10 shows a horizontal cross section of the elevator shaft showing a second embodiment of the invention.

FIG. 10 shows a horizontal cross section of the elevator shaft showing a second embodiment of the invention. This second embodiment differs from the first embodiment in that the first position sensitive detectors 710, 730 are attached to the second attachment means 240, 250 in the apparatus 400 for alignment of guide rails. The support arms 510, 520, 530, 540 of the installation platform 500 are not shown in the figure. The first attachment means 140, 150 of the apparatus 400 for aligning guide rails are used to support the apparatus 400 against the opposite side walls 21C, 21D in the elevator shaft 20. Each guide rail 51, 52 can then be aligned with the second attachment means 250, 250 based on the measurement signals received from the first position sensitive detectors 710, 730 as described in connection with FIGS. 3-5. The position of the apparatus 400 can be determined directly based on the measurement results from the first position sensitive detectors 710, 730 attached to the apparatus 400. The position of the guide rails 51, 52 can be determined indirectly based on the position of the apparatus 400.

Figure 11:
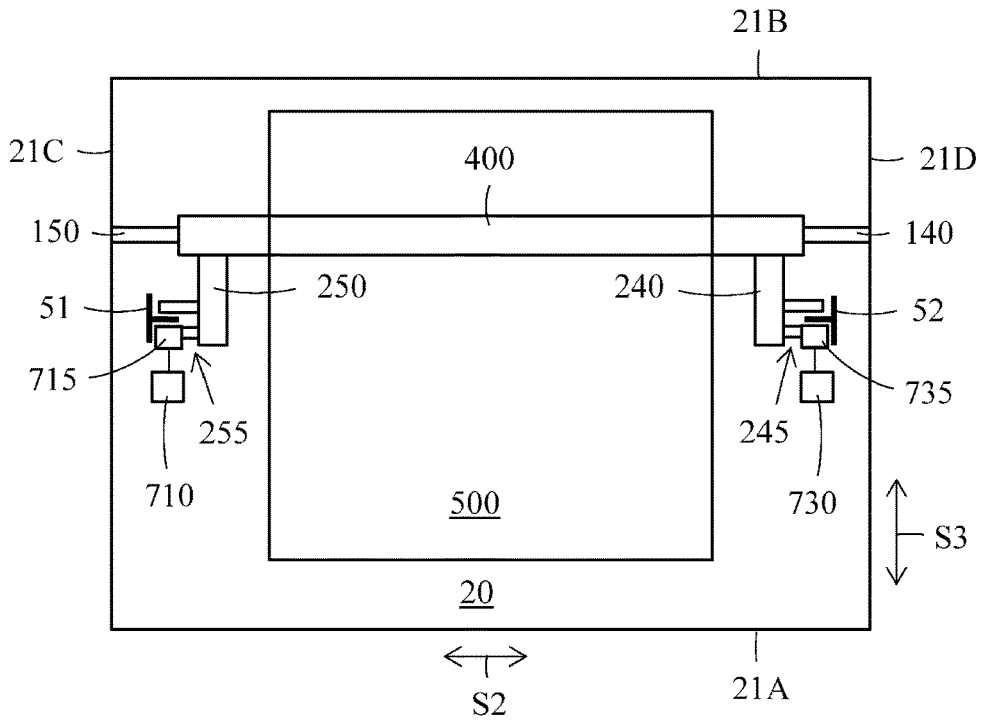
FIG. 11 shows a horizontal cross section of the elevator shaft showing a third embodiment of the invention.

FIG. 11 shows a horizontal cross section of the elevator shaft showing a third embodiment of the invention. This third embodiment differs from the second embodiment in that the first position sensitive detectors 710, 730 are attached via a magnet 715, 735 to a gliding surface the guide rails 51, 52. The position of the guide rails 51, 52 can be determined directly based on the measurement results from the first position sensitive detectors 710, 730 attached to the guide rails 51, 52.

Figure 12:
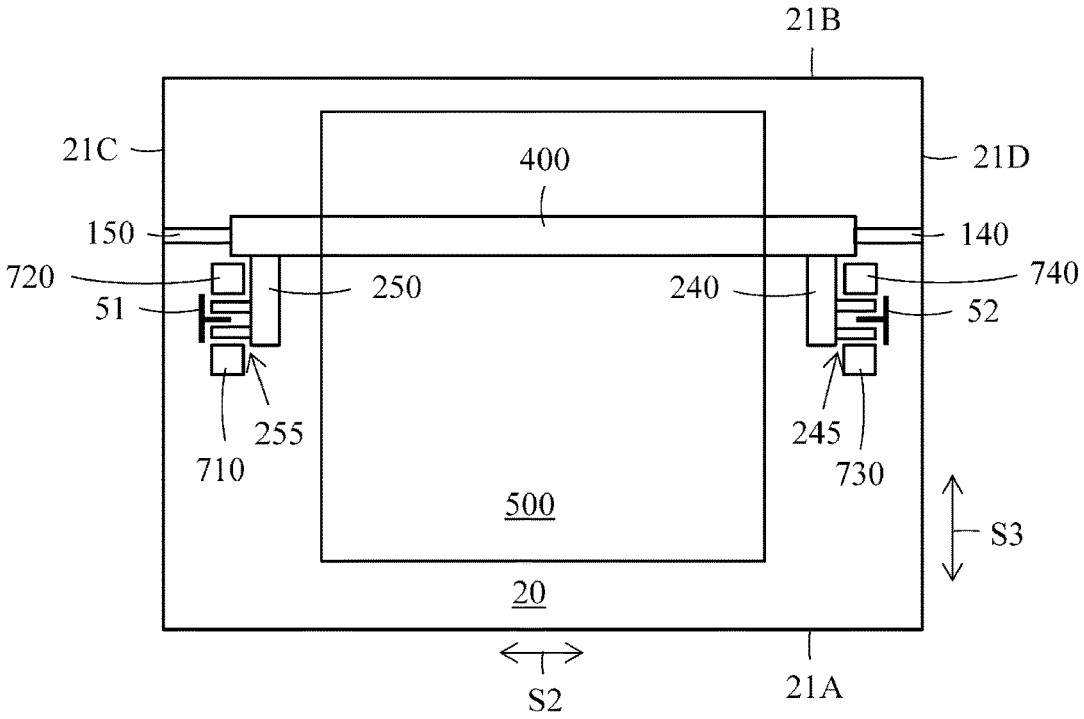
FIG. 12 shows a horizontal cross section of the elevator shaft showing a fourth embodiment of the invention.

FIG. 12 shows a horizontal cross section of the elevator shaft showing a fourth embodiment of the invention. This fourth embodiment differs from the second embodiment in that four first position sensitive detectors 710, 720, 730, 740 are used. The first two of the first position sensitive detectors 710, 720 are attached to a first of the second attachment means 250 of the apparatus 400 at opposite sides of the first car guide rail 51. The second two of the first position sensitive detectors 730, 740 are attached to a second attachment means 240 of the apparatus 500 at opposite sides of the second car guide rail 52. The position of the guide rails 51, 52 can be determined based on the position of the second attachment means 240, 250 of the apparatus 400. The twist of the car guide rails 51, 52 can easily be measured with this arrangement.

Figure 13:
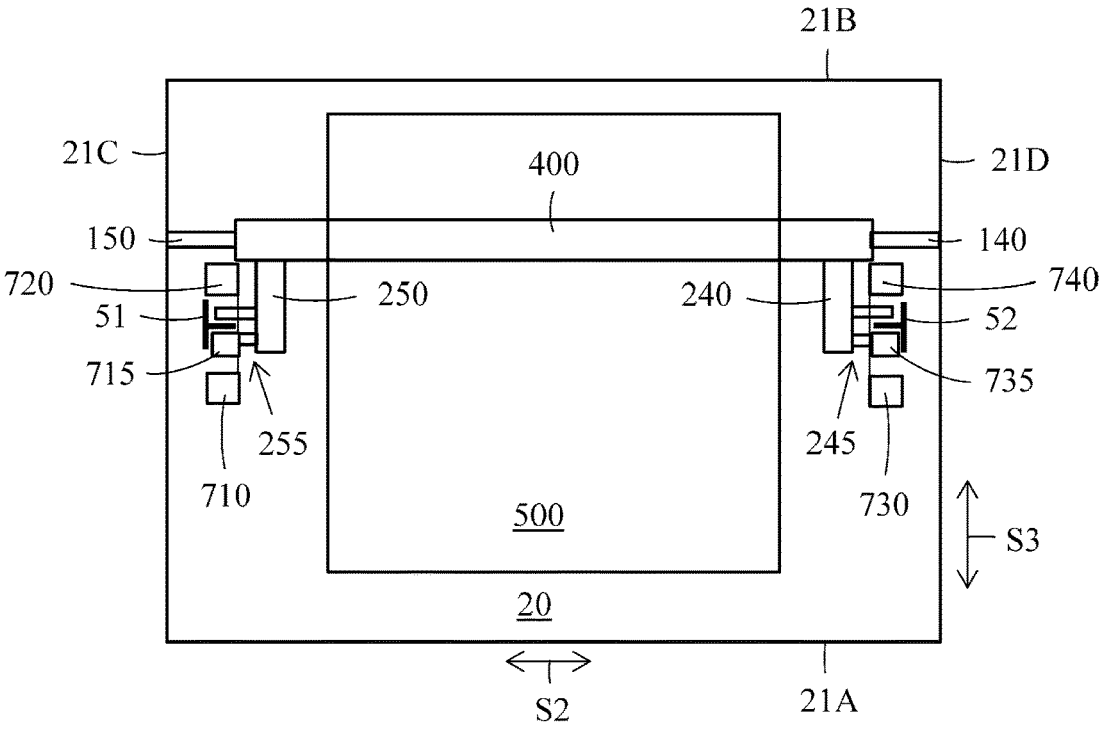
FIG. 13 shows a horizontal cross section of the elevator shaft showing a fifth embodiment of the invention.

FIG. 13 shows a horizontal cross section of the elevator shaft showing a fifth embodiment of the invention. This fifth embodiment differs from the fourth embodiment in that the first position sensitive detectors 710, 720, 730, 740 are attached via a magnet 715, 735 to a gliding surface of the guide rails 51, 52.

Figure 14:
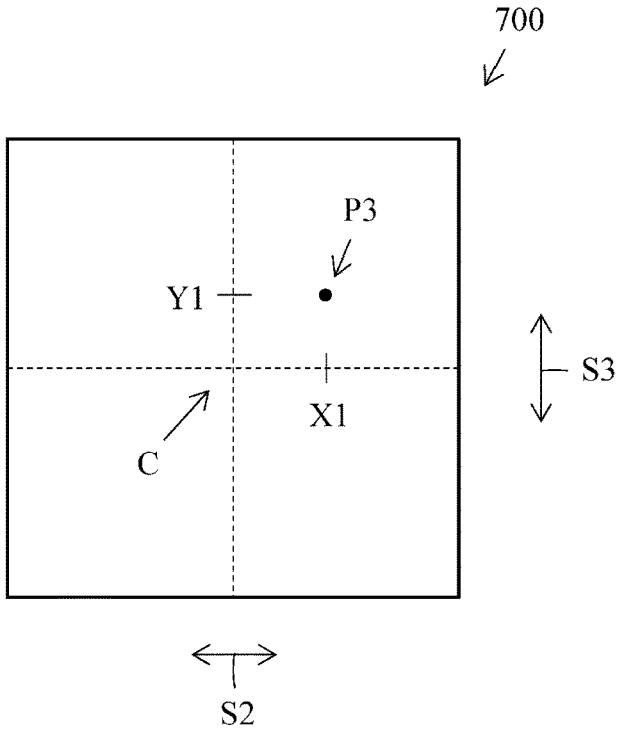
FIG. 14 shows a horizontal cross section of a position sensitive detector.

FIG. 14 shows a horizontal cross section of a position sensitive detector. The position sensitive detector 700 has a centre point C, which forms the centre point for the coordinate system of the position sensitive detector 700. The figure shows a hitting point P3 at which the laser beam PL hits the position sensitive detector 700. The coordinate X1 of the hitting point P3 in the second direction S2 and the coordinate Y1 of the hitting point P3 in the third direction S3 are given as an output signal by the position sensitive detector 700. The idea would then be to change the position of the guide rails 51, 52 so that the laser beam PL hits the position sensitive detector 700 at the centre point C. The centre point C of the position sensitive detector 700 is the reference point for the apparatus 400 for aligning guide rails.

The installation platform 500 may be provided with different installation equipment in addition to the apparatus for aligning guide rails. The installation equipment may be used to install guide rails. The installation equipment may comprise one or several robots being movable on the installation platform 500. The installation platform 500 may be supported with gliding means on the opposite car guide rails 51, 52 during the movement in the first direction S1 upwards and downwards in the elevator shaft 20. A hoist may be used to move the installation platform 500 in the first direction S1 upwards and downwards in the elevator shaft 20.

The arrangement for aligning guide rails has been described in connection with car guide rails 51, 52, but the arrangement can naturally also be used to align counter weight guide rails 52, 53.

Any kind of commercially available position sensitive detector 700 can be used in the invention. The PSD could thus e.g. be formed of a detector having an isotropic sensor surface with a raster-like structure that supplies continuous position data. The PSD could on the other hand e.g. be formed of a detector having discrete sensors on the sensor surface that supply local discrete data.

The transfer of information and control data between the first position sensitive detectors 710, 720, 730, 740 and the control unit 300, between the second position sensitive detectors 750, 760, 770, 780 and the control unit 300 and between the laser transmitters 610, 620, 630, 640 and the control unit 300 may be by wireless communication or by wire. The transfer of information and control data between the installation platform 500 and the control unit 300 and between the apparatus for alignment 400 and the control unit 300 may be by wireless communication or by wire.

The height position of the installation platform 500 and/or of the apparatus 400 for aligning guide rails can be measured by any conventional as such known method. This could be done by a laser based distance sensor. Another possibility would be to use an absolute multi turn encoder and a measurement wheel for measuring the movement of the installation platform 500. There could be a reference mark in the shaft 20 at which the encoder could be reset.

The laser transmitters 610, 620, 630, 640 should be positioned so that the laser beams PL1, PL2, PL3, PL4 can pass freely upwards in the elevator shaft 20 to the first position sensitive detectors 710, 720, 730, 740 and/or to the second position sensitive detectors 750, 760, 770, 780. The laser transmitters 610, 620, 630, 640 should be capable of a long range if they are used in a high-rise building. It the working range of the laser emitters 610, 620, 630, 640 is not sufficient for the whole height of the shaft, then the installation could be done in sections so that the laser transmitters 610, 620, 630, 640 are raised between the intervals. Dust or turbulence of the air in the shaft 20 can cause problems at long distances.

The invention can be used with at least two laser transmitters 610, 620, 630, 640. The apparatus 400 for alignment of guide rails shown in FIGS. 3 to 5 is able to align the apexes of the guide rails 51, 52, 53, 54. Four laser transmitters 610, 620, 630, 640 are, however, needed in order to measure the straightness of the guide rails 51, 52, 53, 54. This is due to the fact that the guide rails 51, 52, 53, 54 often have some twist. The beams L1, L2, L3, L4 of the laser transmitters 610, 620, 630, 640 should be parallel.

The use of laser beams L1, L2, L3, L4 as plumb lines is advantageous compared to the use of mechanical plumb lines. Mechanical plumb lines are formed by wires, which start to vibrate immediately when they are touched by accident. The measurements have to be interrupted until the wire stops vibrating.

The arrangement and the method can be used in elevator installations where the hoisting height in the elevator shaft is over 30 mm, preferably 30-80 meters, most preferably 40-80 meters.

The arrangement and the method can on the other hand also be used in elevator installations where the hoisting height in the elevator shaft is over 75 meters, preferably over 100 meters, more preferably over 150 meters, most preferably over 250 meters.

The installation platform 500 can be used to install car guide rails 51, 52 and/or counter weight guide rails 53, 54.

The use of the invention is not limited to the type of elevator disclosed in the figures. The invention can be used in any type of elevator e.g. also in elevators lacking a machine room and/or a counterweight. The counterweight is in the figures positioned on the back wall of the elevator shaft. The counterweight could be positioned on either side wall of the shaft or on both side walls of the elevator shaft. The lifting machinery is in the figures positioned in a machine room at the top of the elevator shaft. The lifting machinery could be positioned at the bottom of the elevator shaft or at some point within the elevator shaft.

It will be obvious to a person skilled in the art that, as the technology advances, the inventive concept can be implemented in various ways. The invention and its embodiments are not limited to the examples described above but may vary within the scope of the claims.

The invention claimed is:

1. An arrangement for aligning guide rails in an elevator shaft, the elevator shaft having a bottom, a top, side walls, a first direction coinciding with a vertical direction in the elevator shaft, a second direction extending between car guide rails on opposite side walls in the elevator shaft and a third direction extending between a back wall and a front wall in the elevator shaft, said arrangement comprising:

an installation platform arranged to be movable in the first direction upwards and downwards in the elevator shaft, said installation platform being provided with an apparatus for aligning guide rails at least two laser transmitters arranged at predetermined positions in the elevator shaft below the installation platform, each of said at least two laser transmitters transmitting an upwards directed laser beam that forms a plumb line in the elevator shaft;

at least two first position sensitive detectors attached to at least one of the installation platform, the apparatus for aligning guide rails, or the guide rails, each of said at least two first position sensitive detectors receiving a respective laser beam, whereby a position of the guide rails in relation to the elevator shaft can be determined indirectly or directly; and at least two second position sensitive detectors are arranged in the elevator shaft above the installation platform, whereby each laser beam of the laser transmitters is automatically and continuously directed towards a centre of a respective second position sensitive detector so that the bending of the elevator shaft can be taken into consideration when the position of the guide rails is determined.

2. The arrangement according to claim 1, wherein the installation platform comprises support arms arranged on opposite sides of the installation platform and being movable in the second direction for supporting the installation platform on the opposite side walls of the shaft.

3. The arrangement according to claim 2, wherein at least two first position sensitive detectors are attached to the installation platform, whereby the position of the installation platform and thereby the position of the guide rails in relation to the elevator shaft can be determined based on the output signals of the at least two first position sensitive detectors.

4. The arrangement according to claim 2, wherein at least two first position sensitive detectors are attached to the apparatus for aligning guide rails, whereby the position of the apparatus for aligning guide rails and thereby the position of the guide rails in relation to the elevator shaft can be determined based on the output signals of the least two first position sensitive detectors.

5. The arrangement according to claim 2, wherein at least two first position sensitive detectors are attached to the guide rails, whereby the position of the guide rails in relation to the elevator shaft can be determined based on the output signals of the least two first position sensitive detectors.

6. The arrangement according to claim 2, wherein the apparatus for aligning guide rails comprises:

a positioning unit extending horizontally across the elevator shaft in the second direction and comprising a first attachment mechanism movable in the second direction at each end of the positioning unit for supporting the positioning unit on the opposite wall structures of the elevator shaft; and an alignment unit extending across the elevator shaft in the second direction and being supported with support parts on each end portion of the positioning unit so that each end portion of the alignment unit is individually movable in relation to the positioning unit in a third direction perpendicular to the second direction, and comprising a second attachment mechanism movable in the second direction at each end of the alignment unit for supporting the alignment unit on opposite guide rails in the shaft, said second attachment mechanism comprising grippers configured to grip on the guide rail.

7. The arrangement according to claim 1, wherein at least two first position sensitive detectors are attached to the installation platform, whereby the position of the installation platform and thereby the position of the guide rails in relation to the elevator shaft can be determined based on output signals of the at least two first position sensitive detectors.

8. The arrangement according to claim 7, wherein the apparatus for aligning guide rails comprises:

a positioning unit extending horizontally across the elevator shaft in the second direction and comprising a first attachment mechanism movable in the second direction at each end of the positioning unit for supporting the positioning unit on the opposite wall structures of the elevator shaft; and an alignment unit extending across the elevator shaft in the second direction and being supported with support parts on each end portion of the positioning unit so that each end portion of the alignment unit is individually movable in relation to the positioning unit in a third direction perpendicular to the second direction, and comprising a second attachment mechanism movable in the second direction at each end of the alignment unit for supporting the alignment unit on opposite guide rails in the shaft, said second attachment mechanism comprising grippers configured to grip on the guide rail.

9. The arrangement according to claim 1, wherein at least two first position sensitive detectors are attached to the apparatus for aligning guide rails, whereby the position of the apparatus for aligning guide rails and thereby the position of the guide rails in relation to the elevator shaft can be determined based on the output signals of the least two first position sensitive detectors.

10. The arrangement according to claim 9, wherein the apparatus for aligning guide rails comprises:

a positioning unit extending horizontally across the elevator shaft in the second direction and comprising a first attachment mechanism movable in the second direction at each end of the positioning unit for supporting the positioning unit on the opposite wall structures of the elevator shaft; and an alignment unit extending across the elevator shaft in the second direction and being supported with support parts on each end portion of the positioning unit so that each end portion of the alignment unit is individually movable in relation to the positioning unit in a third direction perpendicular to the second direction, and comprising a second attachment mechanism movable in the second direction at each end of the alignment unit for supporting the alignment unit on opposite guide rails in the shaft, said second attachment mechanism comprising grippers configured to grip on the guide rail.

11. The arrangement according to claim 1, wherein at least two first position sensitive detectors are attached to the guide rails, whereby the position of the guide rails in relation to the elevator shaft can be determined based on the output signals of the least two first position sensitive detectors.

12. The arrangement according to claim 11, wherein the apparatus for aligning guide rails comprises:

a positioning unit extending horizontally across the elevator shaft in the second direction and comprising a first attachment mechanism movable in the second direction at each end of the positioning unit for supporting the positioning unit on the opposite wall structures of the elevator shaft; and an alignment unit extending across the elevator shaft in the second direction and being supported with support parts on each end portion of the positioning unit so that each end portion of the alignment unit is individually movable in relation to the positioning unit in a third direction perpendicular to the second direction, and comprising a second attachment mechanism movable in the second direction at each end of the alignment unit for supporting the alignment unit on opposite guide rails in the shaft, said second attachment mechanism comprising grippers configured to grip on the guide rail.

13. The arrangement according to claim 1, wherein the apparatus for aligning guide rails comprises:

a positioning unit extending horizontally across the elevator shaft in the second direction and comprising a first attachment mechanism movable in the second direction at each end of the positioning unit for supporting the positioning unit on the opposite wall structures of the elevator shaft; and an alignment unit extending across the elevator shaft in the second direction and being supported with support parts on each end portion of the positioning unit so that each end portion of the alignment unit is individually movable in relation to the positioning unit in a third direction perpendicular to the second direction, and comprising a second attachment mechanism movable in the second direction at each end of the alignment unit for supporting the alignment unit on opposite guide rails in the shaft, said second attachment mechanism comprising grippers configured to grip on the guide rail.

14. The arrangement according to claim 13, wherein at least two first position sensitive detectors are attached to the second attachment mechanism of the apparatus for aligning guide rails.

15. The arrangement according to claim 1, wherein a control unit is arranged to control the movement of the installation platform and the apparatus for aligning guide rails.

16. The arrangement according to claim 15, wherein the laser transmitters and the control unit are connected so that the angular position of the laser transmitters can be transmitted to the control unit.

17. The arrangement according to claim 15, wherein at least two first position sensitive sensors are connected to the control unit so that output signals of the at least two first position sensitive sensors can be transmitted to the control unit.

18. A method for aligning guide rails in an elevator shaft comprising the step of using the arrangement according to claim 1.

19. A method for aligning guide rails in an elevator shaft, the elevator shaft having a bottom, a top, side walls, a first direction coinciding with a vertical direction in the elevator shaft, a second direction extending between car guide rails on opposite side walls in the elevator shaft and a third direction extending between a back wall and a front wall in the elevator shaft, said method comprising the steps of:

arranging an installation platform to be movable in the first direction upwards and downwards in the elevator shaft, said installation platform being provided with an apparatus for aligning guide rails directing at least two laser beams from predetermined positions in the shaft below the installation platform upwards in the shaft, said at least two laser beams forming plumb lines in the shaft;

attaching at least two first position sensitive sensors to at least one of the installation platform, the apparatus for aligning guide rails, or the guide rails, whereby the at least two position sensitive sensors receive a respective laser beam, and whereby the position of the guide rails in relation to the shaft can be determined indirectly or directly; and arranging at least two second position sensitive detectors in the elevator shaft above the installation platform, whereby each laser beam of the laser transmitters is automatically and continuously directed towards a centre of a respective second position sensitive detector so that the bending of the elevator shaft can be taken into consideration when the position of the guide rails is determined.

* * * * *